US009435305B2

(12) United States Patent
Mechi

(10) Patent No.: US 9,435,305 B2
(45) Date of Patent: Sep. 6, 2016

(54) VALVE ASSEMBLY FOR AN INJECTION VALVE AND INJECTION VALVE

(71) Applicant: Continental Automotive GmbH, Hannover (DE)

(72) Inventor: Marco Mechi, Vada (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 14/780,850

(22) PCT Filed: Apr. 23, 2014

(86) PCT No.: PCT/EP2014/058175

§ 371 (c)(1),
(2) Date: Sep. 28, 2015

(87) PCT Pub. No.: WO2014/173920

PCT Pub. Date: Oct. 30, 2014

(65) Prior Publication Data

US 2016/0053731 A1 Feb. 25, 2016

(30) Foreign Application Priority Data

Apr. 26, 2013 (EP) ..... 13165546

(51) Int. Cl.
*F02M 51/06* (2006.01)

(52) U.S. Cl.
CPC ..... *F02M 51/061* (2013.01); *F02M 51/0671* (2013.01); *F02M 51/0685* (2013.01); *F02M 2200/304* (2013.01)

(58) Field of Classification Search
CPC ..... F02M 51/061; F02M 51/0625; F02M 51/0628; F02M 51/0664; F02M 51/0671; F02M 51/0685; F02M 2200/30; F02M 2200/304; F02M 2200/306
See application file for complete search history.

(56) References Cited

U.S. PATENT DOCUMENTS 5,070,836 A 12/1991 Wahl et al. ..... 123/299
6,367,769 B1 * 4/2002 Reiter ..... F02M 51/0671 239/585.5

(Continued)

FOREIGN PATENT DOCUMENTS

DE 10257686 A1 7/2004 ..... F02D 41/12
DE 10305523 A1 8/2004 ..... F02D 41/22

(Continued)

OTHER PUBLICATIONS

German Office Action, Application No. 102013206600.7, 7 pages, Dec. 12, 2013.

(Continued)

*Primary Examiner* — Darren W Gorman
(74) *Attorney, Agent, or Firm* — Slayden Grubert Beard PLLC

(57) ABSTRACT

A injection valve assembly includes a valve body having a central longitudinal axis and a cavity with a fluid inlet portion and a fluid outlet portion, a valve needle axially movable in the cavity between a closing position that prevents a fluid flow through the fluid outlet portion and further position that release the fluid flow, an electromagnetic actuator unit that actuates the valve needle and includes an armature that is axially movable in the cavity and which includes a main body and a hydraulic damper fixedly coupled to the main body. The hydraulic damper includes an inner surface facing the main body and arranged for contact with the valve needle. The hydraulic damper also has a first opening and second opening (s), wherein the valve needle extends through the first opening, and the second opening (s) provide a fluid passage from the fluid inlet portion to the fluid outlet portion.

14 Claims, 2 Drawing Sheets

(56) References Cited

U.S. PATENT DOCUMENTS

| | | | | |
|---|---|---|---|---|
| 6,520,434 | B1 * | 2/2003 | Reiter | F02M 51/0685 239/533.11 |
| 6,783,109 | B2 * | 8/2004 | Ogura | F02M 51/0671 251/129.15 |
| 6,994,281 | B2 * | 2/2006 | Reiter | F02M 51/0685 239/533.2 |
| 7,139,657 | B2 | 11/2006 | Bouchain et al. | 701/104 |
| 7,506,827 | B2 * | 3/2009 | Petrone | F02M 51/0671 239/585.1 |
| 7,815,128 | B2 | 10/2010 | Beilharz et al. | 239/5 |
| 8,430,343 | B2 | 4/2013 | Nagatomo | 239/585 |
| 8,620,500 | B2 | 12/2013 | Becker et al. | 701/22 |
| 8,973,893 | B2 | 3/2015 | Lehner et al. | 251/129.06 |
| 2012/0013325 | A1 | 1/2012 | Tonner et al. | 324/104 |
| 2013/0255639 | A1 | 10/2013 | Guillen Castillo et al. | 123/472 |

FOREIGN PATENT DOCUMENTS

| | | | | |
|---|---|---|---|---|
| DE | 10345967 | A1 | 4/2005 | F02M 51/06 |
| DE | 102006048979 | A1 | 4/2008 | F02D 41/20 |
| DE | 102008000587 | A1 | 10/2008 | F02D 41/40 |
| DE | 102008000911 | A1 | 10/2009 | B60W 10/06 |
| DE | 102009000741 | A1 | 8/2010 | H01F 7/18 |
| DE | 102009009270 | A1 | 8/2010 | F02D 41/20 |
| DE | 102010017093 | A1 | 12/2010 | F02D 41/20 |
| DE | 102010021169 | A1 | 11/2011 | F02D 41/00 |
| DE | 102011076363 | A1 | 11/2012 | F02M 65/00 |
| EP | 0416265 | A1 | 3/1991 | F02D 41/20 |
| EP | 2527637 | A1 | 11/2012 | F02M 51/06 |
| EP | 2538061 | A2 | 12/2012 | F02D 41/20 |
| JP | 2010096075 | A | 4/2010 | F02M 51/06 |
| JP | 2011137442 | A | 7/2011 | |
| JP | 2011190798 | A | 9/2011 | |
| JP | 2012172594 | A | 9/2012 | F02M 51/06 |
| WO | 02/084102 | A1 | 10/2002 | F02M 51/06 |
| WO | 03/081007 | A1 | 10/2003 | F02D 41/20 |
| WO | 2004/074673 | A1 | 9/2004 | F02M 51/06 |
| WO | 2009/019584 | A2 | 2/2009 | B60K 6/24 |
| WO | 2012/076561 | A1 | 6/2012 | B60W 10/08 |
| WO | 2014/167134 | A1 | 10/2014 | F02D 41/20 |
| WO | 2014/173742 | A1 | 10/2014 | F02D 41/12 |
| WO | 2014/173920 | A1 | 10/2014 | F02M 51/06 |

OTHER PUBLICATIONS

German Office Action, Application No. 102013207555.3, 5 pages, Jan. 23, 2014.

International Search Report and Written Opinion, Application No. PCT/EP2014/057477, 20 pages, Aug. 7, 2014.

International Search Report and Written Opinion, Application No. PCT/EP2014/057680, 18 pages, Aug. 11, 2014.

European Search Report, Application No. 13165546.6, 8 pages, Oct. 14, 2013.

Japanese Office Action, Application No. 2016509442, 6 pages, Jun. 27, 2016.

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2014/058175 filed Apr. 23, 2014, which designates the United States of America, and claims priority to EP Application No. 13165546.6 filed Apr. 26, 2013, the contents of which are hereby incorporated by reference in their entirety.

TECHNICAL FIELD

The invention relates to a valve assembly for an injection valve and an injection valve for a combustion chamber of a combustion engine.

BACKGROUND

Injection valves are in widespread use, in particular for internal combustion engines where they may be arranged in order to dose fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter, and also various elements of the injection valve being responsible for the way the fluid is dosed may vary in a wide range. In addition to that, injection valves may accommodate an actuator for actuating a needle of the injection valve, which may, for example, be an electromagnetic actuator or a piezoelectric actuator.

In order to enhance the combustion process in view of the creation of unwanted emissions, the respective injection valve may be suited to dose fluids under very high pressures. The pressures may be in the case of a gasoline engine in the range of up to 300 bar and in the case of a diesel engine in the range of more than 2000 bar, for example.

WO 2004/074673 A1 discloses a fuel injector with a movable pin for regulating the fuel flow, an armature and an anti-rebound device interposed between the armature and the pin. The anti-rebound device has a deformable elastic plate which is annular in shape, is connected centrally to the pin and is connected laterally to the armature. The elastic plate comprises through holes permitting fuel passage.

SUMMARY

One embodiment provides a valve assembly for an injection valve, comprising a valve body comprising a central longitudinal axis and a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, and an electro-magnetic actuator unit being operable to actuate the valve needle, the actuator unit comprising an armature, the armature being axially movable in the cavity and comprising a main body and a hydraulic damper being fixedly coupled to the main body and having an inner surface facing the main body, the inner surface being arranged to be in contact with the valve needle, the hydraulic damper comprising a first opening and at least one second opening, wherein the valve needle extends through the first opening and the second opening provides a fluid passage from the fluid inlet portion to the fluid outlet portion, wherein the hydraulic damper comprises a side surface directed in direction of the longitudinal axis, the side surface being completely in contact with the main body.

In a further embodiment, the valve assembly includes an armature spring, the armature spring being arranged inside the main body axially between the main body and the valve needle, the armature spring being designed to provide a force acting on the valve needle to bring the valve needle in contact with the inner surface of the hydraulic damper.

In a further embodiment, the main body comprises a hydraulic connection passage along the longitudinal axis, the hydraulic connection passage comprising a projecting part, the armature spring being coupled with one end with the projecting part.

In a further embodiment, the main body of the armature comprises a recess, the hydraulic damper being arranged in the recess.

In a further embodiment, the main body comprising an outside guide surface, the outside guide surface being in contact with the valve body.

In a further embodiment, the hydraulic damper is fixedly coupled to the main body by a welded connection.

In a further embodiment, the valve needle is formed as a solid body.

In a further embodiment, the valve needle has a projecting part for mechanically interacting with the hydraulic damper, an overlapping area of the projecting part of the valve needle and the inner surface of the hydraulic damper is bounded by an inner contour facing the longitudinal axis and an outer contour remote from the longitudinal axis, the area content enclosed by the outer contour having a value which is at least three times the value of the area content enclosed by the inner contour.

Another embodiment provides an injection valve for a combustion chamber of a combustion engine, wherein the injection valve comprises a valve assembly having any or all of the features discussed above.

BRIEF DESCRIPTION OF THE DRAWINGS

Example embodiments of the invention are explained below with reference to the drawings, in which.

DETAILED DESCRIPTION

Figure 1:
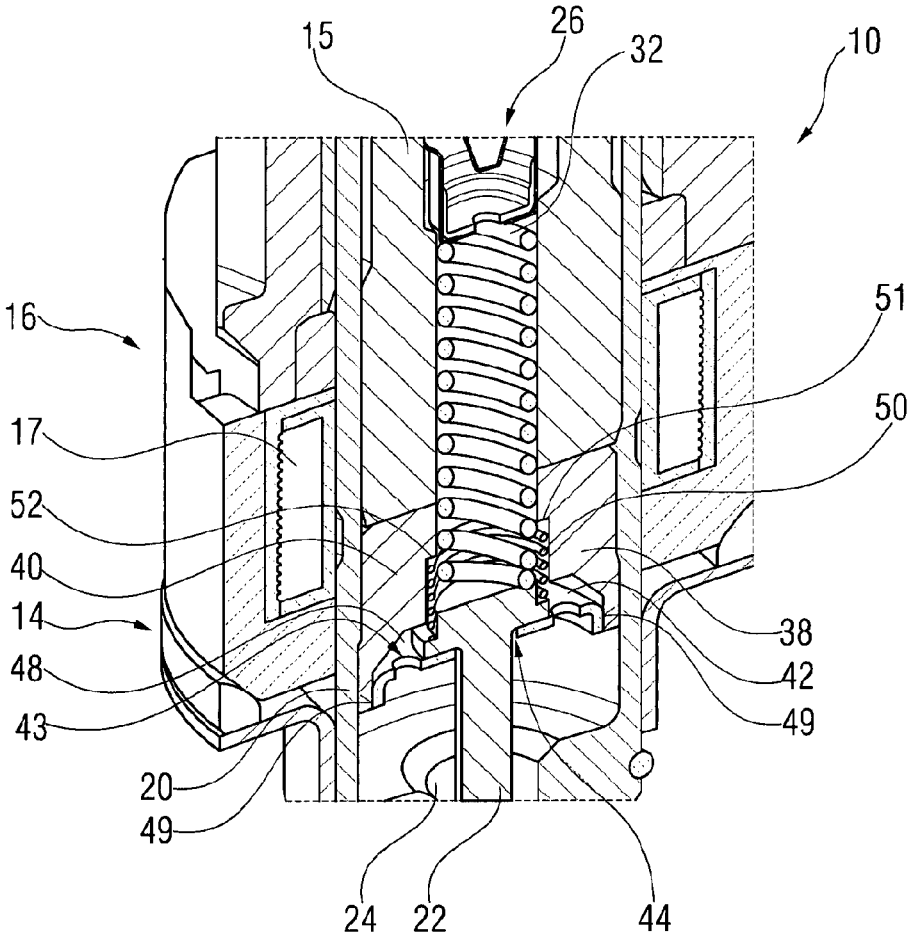
FIG. 1 shows an injection valve in a longitudinal section view with a valve assembly according to an embodiment.

Embodiments of the present disclosure provide a valve assembly that facilitates a reliable and precise function.

In some embodiments of the invention, a valve assembly for an injection valve comprises a valve body that has a central longitudinal axis and comprises a cavity with a fluid inlet portion and a fluid outlet portion. The valve assembly comprises a valve needle axially movable in the cavity, i.e. in particular the valve needle is axially movable with respect to the valve body. The valve needle prevents a fluid flow through the fuel outlet portion in a closing position and releases the fluid flow through the fuel outlet portion in further positions.

The valve assembly comprises an electromagnetic actuator unit that is operable to actuate the valve needle, in particular for axially displacing the valve needle away from the closing position. The actuator unit comprises an armature. The armature is axially movable in the cavity. Expediently, the armature may be axially displaceable with respect to the valve body and with respect to the valve needle. The armature comprises a main body and a hydraulic damper that is fixedly coupled to the main body. Preferably, the hydraulic damper is a one-piece element.

The hydraulic damper has an inner surface facing the main body. The inner surface may expediently face away from the fluid outlet end. The inner surface is arranged to be in contact with the valve needle, i.e. the inner surface is in particular operable to block axial movement of the armature with respect to the valve needle in direction away from the fluid outlet portion. For example, the valve needle may have a projection part such as a collar—in particular at its end facing away from the fluid outlet portion—for mechanically interacting with the hydraulic damper. In this way, the armature may be operable to take the valve needle with it—in particular by means of mechanical interaction between the hydraulic damper and the collar—when it moves away from the fluid outlet portion in order to displace the valve needle away from the closing position.

In one embodiment, an overlapping area of the projecting part of the valve needle and the inner surface of the hydraulic damper is, in a plane comprising the inner surface, bounded by an inner contour facing the central longitudinal axis and an outer contour remote from the central longitudinal axis. The overlapping area is in particular that portion of the inner surface of the hydraulic damper which is covered by the valve needle in top view along the longitudinal axis towards the fluid outlet portion.

The hydraulic damper has a first opening through which the valve needle extends. For example in this case, the inner contour may correspond to an edge of a side-face of the opening, the edge being comprised by the inner surface of the hydraulic damper. The edge may have an annular shape. The outer contour of the overlapping area may be congruent to an outer contour of the projecting portion of the valve needle in top view along the central longitudinal axis.

The area content enclosed by the outer contour preferably has a value which is at least three times the value of the area content enclosed by the inner contour. In one development, the area content enclosed by the outer contour is ten times or less the area content enclosed by the inner contour. For example, the following holds true for a ratio of the area content Ao enclosed by the outer contour and the area content Ai enclosed by the inner contour: $3 \leq Ao/Ai \leq 7$, in particular $3.24 \leq Ao/Ai \leq 6.25$. The area content of the overlapping area is preferably the difference of the area content enclosed by the outer contour and the area content enclosed by the inner contour.

In one embodiment, the overlapping area has a ring-shape having an inner diameter Ri and an outer diameter Ro, wherein $1.5 \leq Ro/Ri \leq 3$, in particular $1.8 \leq Ro/Ri \leq 2.5$. For example the inner diameter has a value between 3 mm and 6 mm, preferably between 4 mm and 5 mm, wherein the limits are included in each case. The outer diameter may have a value between 8 mm and 12 mm, preferably between 9 mm and 10 mm, wherein the limits are included in each case.

One advantage of such an overlapping area is that fluid which is located in a gap between the projecting part of the valve needle and the inner surface of the hydraulic damper enables a damping of the relative movement between the valve needle and the armature. A further advantage is that due to fluid being located in the gap between the projecting part of the valve needle and the inner surface of the hydraulic damper, a sticking effect between the valve needle and the hydraulic damper may occur when the inner surface of the hydraulic damper moves out of contact with the valve needle. For example, fluid is moving into the gap between the projecting part of the valve needle and the inner surface of the hydraulic damper in the region of the overlapping area when the projecting part and the hydraulic damper move away from each other. This fluid movement may result in attractive—in particular hydrodynamic—forces acting against increasing the gap between the projecting part and the hydraulic damper. In this way, energy is dissipated in particularly efficient fashion due to the comparatively large area content of the overlapping area. Consequently, a particularly fast deceleration of the relative movement of the valve needle with respect to the armature or of the armature with respect to the valve needle, respectively, may be achieved.

The hydraulic damper comprises at least one second opening. The second opening provides a fluid passage from the fluid inlet portion to the fluid outlet portion. The second opening is preferably laterally offset with respect to the valve needle.

This has the advantage that the dynamics of the movement of the valve needle may be very good. In particular, due to the arrangement of the main body, the hydraulic damper and the valve needle that is able to decouple from the hydraulic damper an overshoot of the movement of the valve needle may be avoided when the valve needle moves out of its closing position. Further, a needle reopening after the closing (bounce) is avoided, in particular by the armature being operable to decouple from the valve needle when the latter reaches the closing position. Consequently, the amount of injected fluid may be controlled in a very precise manner.

Since the valve needle and the inner surface of the hydraulic damper are designed to be in contact with each other, fluid which is located between the inner surface and the valve needle enables a damping of the relative movement between the hydraulic damper and the valve needle. The valve needle and the inner surface of the hydraulic damper are coupled together by hydraulic sticking. During the closing phase of the valve assembly the needle and the armature move together. For example, the valve assembly has a calibration spring which forces the valve needle towards the fluid outlet portion and the valve needle takes the armature with it by means of mechanical interaction with the hydraulic damper, in particular by means of mechanical interaction of the collar of the valve needle with the hydraulic damper. When the valve needle hits the injector seat, the movement of the valve needle is stopped but the armature may decouple from the valve needle and is free to move further downwards. Thus, the risk of a bounce of the needle and an unwanted reopening of the valve assembly is particularly small.

For example during axial travel of the armature towards the fluid outlet portion with respect to the valve needle, kinetic energy of the armature is dissipated by the sticking effect between the valve needle and the inner surface of the hydraulic damper. The dissipation is at a maximum when the needle hits the seat. Therefore, the deceleration of the armature at the closing instant is particularly large. This improves the possibility to use the electromagnetic actuator unit as a sensor during the closing phase to exactly detect the closing instant—in particular by measuring the voltage which is induced in a coil of the electromagnetic actuator unit due to velocity changes of the armature. When using the electromagnetic actuator unit as a sensor, the behaviour of each injection valve can be electronically corrected to improve performance. The amplitude and the sharpness of the voltage drop detected by means of the electronic control unit (ECU) depends from the variation of velocity on time of the armature. Since the armature is rapidly decelerated by the hydraulic sticking effect between the valve needle and the inner surface of the hydraulic damper at the moment of the closing of the valve assembly, the signal of the voltage drop is sharp. Therefore, the valve assembly can be used very well as a sensor to exactly detect the closing instant.

Since the hydraulic damper and the valve needle can decouple, after the closing instant and the main deceleration of the armature, the armature can move further downwards—i.e. towards the fluid outlet portion—relative to the valve needle. Therefore, the risk of an unwanted additional movement of the valve needle due to bouncing may be particularly small and a very good closing characteristic of the valve needle can be obtained.

When the hydraulic damper moves towards the fluid outlet portion, in particular relative to the valve body and to the valve needle, this movement is damped due to the fluid being located inside the armature. The fluid can only flow through the second opening and therefore slows down the movement of the hydraulic damper and the main body of the armature. Consequently, the movement of the armature relative to the valve needle is damped and a very good closing characteristic of the valve needle can be obtained.

According to further embodiments the main body of the armature comprises a recess. The hydraulic damper is arranged in the recess. Thus, a compact design of the armature is possible.

According to further embodiments the hydraulic damper comprises a side surface directed in the direction of the longitudinal axis. In other words, any normal vector on the side surface is perpendicular to the longitudinal axis. The side surface is completely in contact with the main body. Additionally, the hydraulic damper comprises a part that is perpendicular to the longitudinal axis and that comprises the inner surface as well as the first opening and the second opening. The hydraulic damper is completely arranged inside the main body of the armature. The side surface of the hydraulic damper is provided for fixing the hydraulic damper in the main body such that no relative movement of the hydraulic damper with respect to the main body is possible. For example the hydraulic damper is welded to the main body at the side surface.

According to further embodiments the valve assembly comprises an armature spring, in particular in addition to the calibration spring. The armature spring is arranged inside the main body between the main body and the valve needle. The armature spring is designed to provide a force acting on the valve needle to bring the valve needle into contact with the inner surface of the hydraulic damper. Specifically, the armature spring may bias the armature in the direction away from the fluid outlet portion with respect to the valve needle, and, what is equivalent, it may bias the valve needle in the direction towards the fluid outlet portion with respect to the armature. In particular, due to the arrangement of the armature spring, an overshoot of the armature may be limited during the movement of the valve needle into its closing position or an overshoot of the valve needle may be limited during the movement of the valve needle out of its closing position.

According to further embodiments, the main body comprises a hydraulic connection passage along the longitudinal axis. The hydraulic connection passage is hydraulically coupled with the second opening of the hydraulic damper. The hydraulic connection passage comprises a projecting part, for example a step, and the armature spring is coupled with one end with the projecting part.

According to further embodiments the main body comprises an outside guide surface. The outside guide surface in particular faces towards the valve body; preferably it faces away from the recess. The outside guide surface may expediently be directed in the direction of the longitudinal axis. The armature may interact with the valve body by means of the outside guide surface for axially guiding the armature. The outside guide surface may be in sliding contact with the valve body. Thus, a guiding of the armature is realized in a simple manner. With advantage, particular small tilt angles of the armature with respect to the longitudinal axis are achievable by means of guiding the armature at the outside guide surface.

Other embodiments provide an injection valve for a combustion chamber of a combustion engine comprises the valve assembly as described above.

Figure 3:
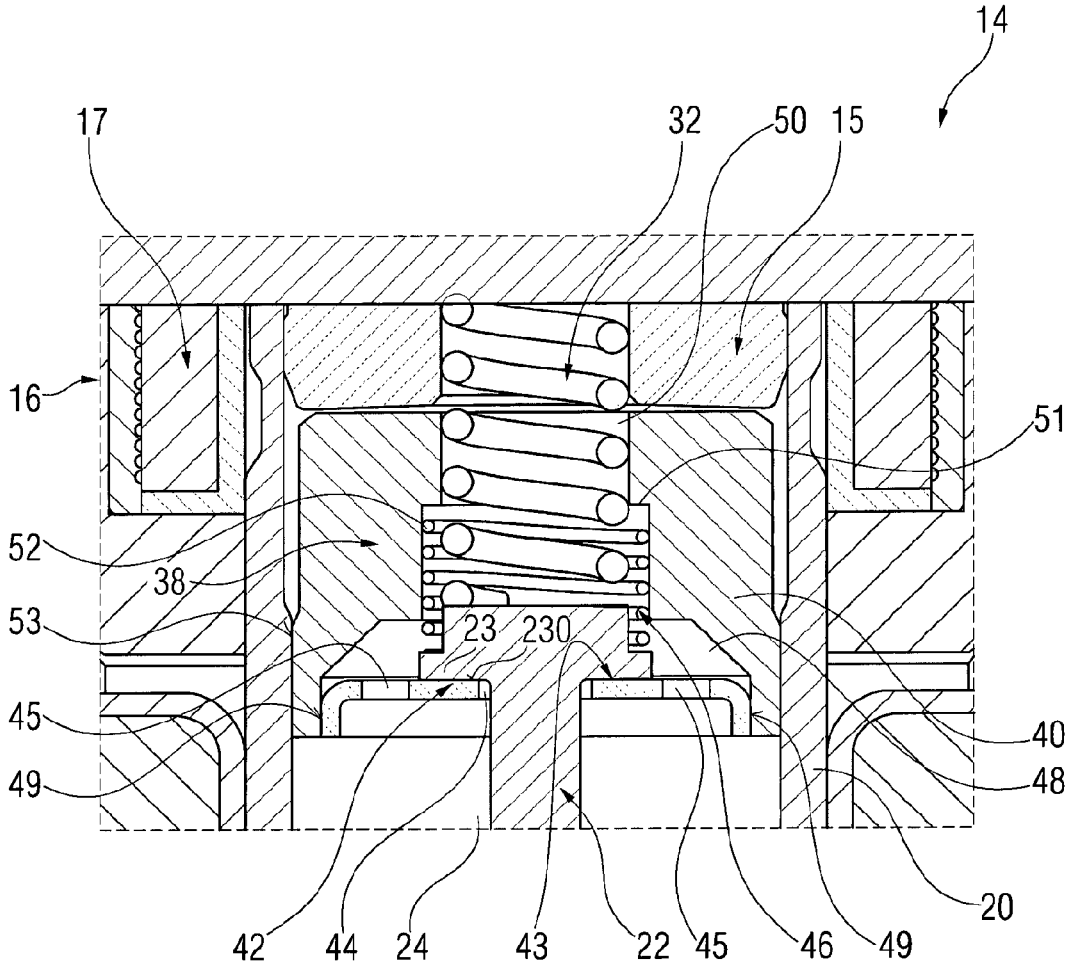
FIG. 3 shows an injection valve in a longitudinal section view with a valve assembly according to an embodiment.

An injection valve 10 (FIG. 1 and FIG. 3) may be used as a fuel injection valve for a combustion chamber of an internal combustion engine and comprises a valve assembly 14 with an actuator unit 16 which is preferably an electromagnetic actuator unit. The shown injection valve 10 is of an inward opening type. Alternatively, the injection valve 10 may be of an outward opening type.

Figure 2:
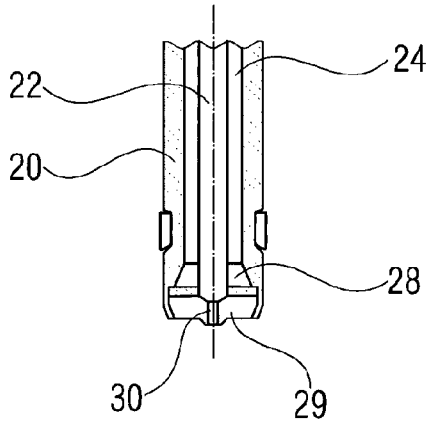
FIG. 2 shows an outlet region of an injection valve in a longitudinal section view according to an embodiment.

The valve assembly 14 comprises a valve body 20 that has a central longitudinal axis L. The valve assembly 14 further comprises a valve needle 22. Preferably, the valve needle 22 is solid. The valve needle 22 is not hollow. The valve needle 22 is arranged in a cavity 24 of the valve body 20 in axially moveable fashion. The cavity 24 is axially led through the valve body 20 and has a fluid inlet portion 26 and a fluid outlet portion 28, in particular at opposite ends of the valve body 20 (FIG. 2). The fluid inlet portion 26 is designed to be hydraulically coupled to a high pressure fuel chamber of an internal combustion engine, wherein the fuel is stored under high pressure, e.g. to a fuel rail.

In a closing position of the valve needle 22, the valve needle 22 sealingly rests on a seat 29 (FIG. 2), thereby preventing a fluid flow through at least one injection nozzle in the valve body 20. The seat 29 may be made in one part with the valve body 20. Alternatively it may be separate from the valve body 20 and fixed to the valve body 20. A calibration spring 32 is arranged inside the valve body 20. The calibration spring 32 is mechanically coupled to the valve needle 22.

The actuator unit 16 comprises a coil 17 and an armature 38. The coil 17 is arranged inside a housing. The coil 17 or the coil 17 and the housing may be arranged circumferentially around the valve body 20. The armature 38 is arranged in the cavity 24 and axially movable with respect to the valve body 20 and the valve needle 22. The coil 17, a pole piece 15 and the armature 38 make part of an electromagnetic circuit. The pole piece 15 may be fixedly coupled with the valve body 20.

The armature 38 has a main body 40 and a hydraulic damper 42 which are expediently separately manufactured parts. Inside the main body 40 is a hydraulic connection passage 50 that allows fluid flow from the fluid inlet portion 26 towards the fluid outlet portion 28 through the main body 40 via the connection passage 50. The hydraulic connection passage 50 extends through the main body 40 along the longitudinal axis L and opens into a recess 48 of the main body 40, the recess being located at the end of the main body 40 facing the fluid outlet portion 28. One end portion of the valve needle 22 is at least partially arranged in the recess 48.

The calibration spring 32 extends through the hydraulic connection passage 50 to the end portion of the valve needle 22.

An armature spring 46 is arranged inside the main body 40. The armature spring 46 is connected with one end 52 with a projecting part 51 of the main body 40. The axially opposite end of the armature spring 46 is supported at the valve needle 22. The armature spring 46 exerts a force on the valve needle 22 in direction towards the fuel outlet portion 28 with respect to the armature 38. It exerts a force on the armature 38 in direction towards the fuel inlet portion 26 with respect to the valve needle 22. The main body 40 and the valve body 20 have a common guide area at an outside guide surface 53 of the main body 40. The guide surface 53 guides the movement of the armature 8 along the longitudinal axis L. With advantage, a radial gap between the valve body 20 and the armature 38 may be particularly small in the guide area. The distance between the outside guide surface 53 and the valve body may be, for example, 80 μm or less, preferably 40 μm or less, in particular 20 μm or less. In one development, the distance has a value of around 10 μm.

The hydraulic damper 42 is arranged at the side of the main body 40 that is located towards the fuel outlet portion 28. In other words, the hydraulic damper 42 covers the main body 40 at least partially when viewed along the longitudinal axis L towards the fluid inlet portion 26. The hydraulic damper 42 may be generally disk-shaped and comprises a side surface 49 that is directed in direction of the longitudinal axis L. The main body 40 and the hydraulic damper 42 are connected at the side surface 49. For example, the hydraulic damper 42 and the main body 40 are welded together at the side surface 49. The hydraulic damper 42 is completely arranged inside the main body 40.

The hydraulic damper 42 comprises a first opening 44. The first opening 44 is located at the middle region of the hydraulic damper 42, such that the valve needle 22 can extend from one side of the hydraulic damper 42 to the other side of the hydraulic damper 42 along the longitudinal axis L.

The end portion of the valve needle 22 that is arranged inside the armature 38, in particular in the recess of the main body 48, has at least one projecting part 23—for example a collar which may be in one piece with a shaft of the valve needle 22 or may be fixed to the shaft—that has at least one planar surface 230. In particular, the planar surface 230 of the projecting part 23 faces towards the fluid outlet portion 28. The hydraulic damper has an inner surface 43, the inner surface 43 in particular facing towards the fluid inlet portion 26 and being arranged subsequent to the planar surface 230 of the projecting part 23 in direction towards the fluid outlet portion 28. The planar surface 230 of the projecting part 23 and the inner surface 43 of the hydraulic damper 42 overlap when viewed along the longitudinal axis L so that the planar surface can be in contact with the inner surface 43 of the hydraulic damper 42.

The planar surface 230 of the projecting part 23 and the inner surface 43 of the hydraulic damper 42 have an overlapping area. The overlapping area corresponds to the contacting portions of the planar surface 230 and of the inner surface 43. In the present embodiment, overlapping area is ring-shaped, having an inner contour with an inner diameter Ri and and outer contour having an outer diameter Ro. The outer diameter Ro is, for example, at twice as large as the inner diameter Ri—for example the outer diameter has a value of 10 mm and the inner diameter has a value of 5 mm—so that a ratio Ro/Ri has a value of 2. The ratio of the corresponding areas Ai and Ao which are enclosed by the inner contour and the outer contour in the plane of the inner surface 43, respectively, has a value of $Ao/Ai=Ro^2/Ri^2$, i.e. Ao/Ai=4 in the present embodiment.

The hydraulic damper 42 comprises at least one second opening 45. According to further embodiments the hydraulic damper 42 comprises more than one second opening 45, for example two or more second openings 45. The second openings 45 allow a fluid flow from the fluid inlet portion 26 through the recess 48 of the main body 40 to the fluid outlet portion 28. The first and second openings 44, 45 may perforate the inner surface 43 of the hydraulic damper 42. The second opening(s) 45 is/are preferably laterally off-set with respect to the planar surface 230 of the projecting part 23, i.e. there is in particular no overlap with the planar surface 230 when viewed in axial direction towards the fluid outlet portion 28.

In the following the function of the injection valve 10 is described:

The fluid is led from the fluid inlet portion 26 to the cavity 24 of the valve body 20. The fluid goes through the inner region of the main body 40 via the hydraulic connection passage 50 where the calibration spring 32 is arranged and enters the recess 48 where the hydraulic damper 42 is arranged. The fluid passes the hydraulic damper 42 through the second openings 45 and is led further to the fluid outlet portion 28. The valve needle 22 prevents a fluid flow through the fluid outlet portion 28 in a closing position of the valve needle 22. Outside of the closing position of the valve needle 22, the valve needle 22 enables the fluid flow through the injection nozzle 30.

When the electromagnetic actuator unit 16 gets energized, the actuator unit 16 may effect an electromagnetic force on the armature 38 by means of coil 17. The armature 38 is attracted by the coil 17 and moves in axial direction away from the fluid outlet portion 28. The armature 38, in particular the hydraulic damper 42, takes the valve needle 22 with it so that the valve needle 22 moves in axial direction out of the closing position against the force of the calibration spring 32.

Axial displacement of the armature 38 with respect to the valve body 20 may be limited by pole piece 15, for example. When the armature 38 hits the pole piece 15, the planar surface 230 of the projecting part 23 of the valve needle 22 may decouple from the inner surface 43 of the hydraulic damper 42 and the valve needle 22 may move further in axial direction towards the fluid inlet portion 26. This further travel is also called "overshoot" of the valve needle 22. Fluid which moves between the inner surface 43 of the hydraulic damper 42 and the projecting part 23 of the valve needle when the projecting part 23 moves out of contact with the inner surface 43 causes a sticking effect between the valve needle 22 and the hydraulic damper 42. Consequently, the movement of the valve needle 22 relative to the armature 38 may be damped and the overshoot of the valve needle 22 may be particularly small. Furthermore, the armature spring 36 may limit the overshoot of the valve needle 22.

The projecting part 23 may subsequently be forced back into contact with the inner surface 43 by means of the calibration spring 32. Fluid being squeezed out of the gap between the planar surface 230 of the projecting part 23 of the valve needle 22 and the inner surface 43 of the hydraulic damper 42 contributes to dissipate kinetic energy of the valve needle 22 when the projecting part 23 comes into contact with the inner surface 43.

When the actuator unit 16 is de-energized the calibration spring 32 forces the valve needle 22 to move in axial direction in its closing position. The valve needle 22 takes the hydraulic damper 42 and the main body 40 with it by means of mechanical interaction between the planar surface 230 of the projecting part 23 of the valve needle and the inner surface 43 of the hydraulic damper 42.

Axial displacement of the valve needle 22 with respect to the valve body 20 is limited by valve seat 29. When the valve needle 22 hits the valve seat 29, the inner surface 43 of the hydraulic damper 42 may decouple from the planar surface 230 of the projecting part 23 of the valve needle 22 and the armature 38 may move further in axial direction towards the fluid outlet portion 28, thereby compressing the armature spring 46. This further travel is also called "overshoot" of the armature 38. Fluid which is moved between the inner surface 43 and the projecting part 23 of the valve needle 22 when the inner surface 43 moves out of contact with the projecting part 23 causes the sticking effect between the inner surface 43 and the valve needle 22 and damps the relative movement between the armature 38 and the valve needle 22. Therefore, when the needle 22 hits the seat 29, the kinetic energy of the armature is dissipated by the sticking effect between the valve needle 22 and the inner surface 43 of the hydraulic damper 42.

In principle, the armature 38 is free to move relative to the valve needle 22 and thus a bouncing of the valve needle 22 may be avoided. Due to the sticking effect between the inner surface 43 and the valve needle 22, this movement of the armature 38 with respect to the valve needle 22 may be delayed. The sticking force between the inner surface 43 and the valve needle 22 leads to a deceleration of the armature 38 at the closing instant. By means of the hydraulic damper 42, a particularly fast deceleration is achievable. After the closing instant the armature 38 and the needle 22 decouple such that the bouncing of the valve needle is avoided.

Next, the armature 38 moves in direction towards the fluid inlet portion 26 relative to the valve needle 22 and the valve body 20. Specifically, the armature spring 46 forces the inner surface 43 of the hydraulic damper 42 back into contact with the planar surface 230 of the projecting part 23 of the valve needle 22. During this movement of the armature 38 the fluid that is inside the main body 40 and, in particular, in the recess 48, must flow through the second openings 45. In one embodiment, the cross-section of the second openings 45 is selected such that this fluid flow is hampered to damp the movement of the armature 38 in direction of the fluid inlet portion 26. In addition or alternatively, fluid being squeezed out of the gap between the projecting part 23 of the valve needle 22 and the inner surface 43 of the hydraulic damper 42 contributes to dissipate kinetic energy of the armature 38. Thus, a soft landing of the inner surface 43 of the hydraulic damper 42 on the valve needle 22 is realized. Therefore, the risk of reopening of the injector valve 10 is minimized. Further, since the fluid flow goes through the centre of the armature 38 and through the second openings 45 of the hydraulic damper 42, the pressure drop is minimized.

With the armature 38 that comprises the hydraulic damper 42 with the first opening 44 and second openings 45, the risk of a bounce due to quick deceleration of the valve needle that hits against the valve seat, is advantageously reduced. The hydraulic damper 42 may work in all critical dynamic phases of the injector, for example during the collision of the armature 38 and the pole piece 15, during the overshoot of the valve needle, during the collision of the valve needle 22 with the valve seat 29 and when the armature 38 moves back in the starting position at the end of the closing phase.

The guide surface 53 provides a very precise axial movement with low contact pressure between the main body 40 and the valve body 20.

The overshoot of the needle during the opening of the needle 22 is reduced due to the sticking effect between the hydraulic damper 42 and the valve needle 22 and the armature spring 46. When the voltage induced in the coil 15 is measured in the closing phase for detecting when the valve needle 22 reaches the closing position, the sensor signal shape is improved due to high deceleration of the armature 38 during closing of the injection valve 10. The sensor signal amplitude is improved due to the reduced radial gap between the armature 38 and the valve body 20. The pressure drop between the inlet portion 26 and the outlet portion 28 may be particularly low due to large hydraulic diameters hydraulic connection passage 50 and of the second openings 45 which are achievable in embodiments of the valve assembly according to the present disclosure. The mass of the injection valve 10 may be particularly low. According to embodiments the assembly process of the valve assembly 14 is easy since there is only one single welding necessary for producing the armature/needle assembly. The magnetic force is increased with respect to a usual design due to an increased area in the axial gap.

What is claimed is:

1. A valve assembly for an injection valve, the valve assembly comprising:

a valve body comprising a central longitudinal axis and a cavity with a fluid inlet portion and a fluid outlet portion, a valve needle axially movable in the cavity, the valve needle preventing a fluid flow through the fluid outlet portion in a closing position of the valve needle and allowing the fluid flow through the fluid outlet portion in further positions of the valve needle, an electro-magnetic actuator unit configured to actuate the valve needle, the actuator unit comprising an armature that is axially movable in the cavity, wherein the armature comprises:

a main body, and a hydraulic damper fixedly coupled to the main body and having an inner surface facing the main body, the inner surface configured to contact the valve needle in certain positions of the valve needle, wherein the hydraulic damper comprises:

a first opening and at least one second opening, wherein the valve needle extends through the first opening and the second opening provides a fluid passage from the fluid inlet portion to the fluid outlet portion, and a side surface extending in a direction of the longitudinal axis, wherein the side surface is completely in contact with the main body.

2. The valve assembly of claim 1, comprising an armature spring arranged inside the main body axially between the main body and the valve needle, wherein the armature spring is configured to provide a force acting on the valve needle to bring the valve needle in contact with the inner surface of the hydraulic damper.

3. The valve assembly of claim 2, wherein the main body comprises a hydraulic connection passage extending along the longitudinal axis, the hydraulic connection passage comprising a projecting part, wherein the armature spring is coupled with one end with the projecting part.

4. The valve assembly of claim 1, wherein the main body of the armature comprises a recess in which the hydraulic damper is arranged.

5. The valve assembly of claim 1, wherein the main body comprises an outside guide surface in contact with the valve body.

6. The valve assembly of claim 1, wherein the hydraulic damper is fixedly coupled to the main body by a welded connection.

7. The valve assembly of claim 1, wherein the valve needle is formed as a solid body.

8. The valve assembly of claim 1, wherein:

the valve needle has a projecting part configured to mechanically interact with the hydraulic damper, and an overlapping area of the projecting part of the valve needle and the inner surface of the hydraulic damper is bounded by an inner contour facing the longitudinal axis and an outer contour remote from the longitudinal axis, wherein an area enclosed by the outer contour is at least three times an area enclosed by the inner contour.

9. The valve assembly of claim 4, wherein the hydraulic damper is completely arranged inside the main body of the armature.

10. The valve assembly of claim 9, wherein the hydraulic damper is welded to the main body at the side surface.

11. The valve assembly of claim 1, wherein the hydraulic damper comprises a part that is perpendicular to the longitudinal axis and that comprises the inner surface as well as the first opening and the second opening.

12. An injection valve for a combustion chamber of a combustion engine, the injection valve comprising:

a valve assembly comprising:

a valve body comprising a central longitudinal axis and a cavity with a fluid inlet portion and a fluid outlet portion, a valve needle axially movable in the cavity, the valve needle preventing a fluid flow through the fluid outlet portion in a closing position of the valve needle and allowing the fluid flow through the fluid outlet portion in further positions of the valve needle, an electro-magnetic actuator unit configured to actuate the valve needle, the actuator unit comprising an armature that is axially movable in the cavity, wherein the armature comprises:

a main body, and a hydraulic damper fixedly coupled to the main body and having an inner surface facing the main body, the inner surface configured to contact the valve needle in certain positions of the valve needle, wherein the hydraulic damper comprises:

a first opening and at least one second opening, wherein the valve needle extends through the first opening and the second opening provides a fluid passage from the fluid inlet portion to the fluid outlet portion, and a side surface extending in a direction of the longitudinal axis, wherein the side surface is completely in contact with the main body.

13. A valve assembly for an injection valve, comprising:

a valve body comprising a central longitudinal axis and a cavity with a fluid inlet portion and a fluid outlet portion, a valve needle axially movable in the cavity, the valve needle preventing a fluid flow through the fluid outlet portion in a closing position of the valve needle and allowing the fluid flow through the fluid outlet portion in further positions of the valve needle, an electro-magnetic actuator unit configured to actuate the valve needle, the actuator unit comprising an armature that is movable in the cavity, wherein the armature comprises:

a main body, and a hydraulic damper fixedly coupled to the main body and having an inner surface facing the main body, the inner surface arranged to be in contact with the valve needle in certain positions of the valve needle, wherein the hydraulic damper comprises a first opening and at least one second opening, wherein the valve needle extends through the first opening and the second opening provides a fluid passage from the fluid inlet portion to the fluid outlet portion, and an armature spring arranged inside the main body axially between the main body and the valve needle, wherein the armature spring is configured to provide a force acting on the valve needle to bring the valve needle in contact with the inner surface of the hydraulic damper.

14. The valve assembly of claim 13, wherein the main body comprises a hydraulic connection passage along the longitudinal axis, the hydraulic connection passage comprising a projecting part, the armature spring being coupled with one end with the projecting part.

* * * * *